US005591051A

United States Patent [19]

Ittah

[11] Patent Number: 5,591,051

[45] Date of Patent: Jan. 7, 1997

[54] FEMALE ELECTRIC CONTACT MEMBER AND ELECTRIC CONNECTOR CASING ELEMENT ADAPTED TO RECEIVE SAME

[75] Inventor: Jean Ittah, Villeneuve la Garenne, France

[73] Assignee: Connecteurs Cinch, Societe Anonyme, Montigny le Bretonneux, France

[21] Appl. No.: 346,284

[22] Filed: Nov. 23, 1994

[30] Foreign Application Priority Data

Dec. 15, 1993 [FR] France ..... 93 15091

[51] Int. Cl.[6] ..... H01R 13/514

[52] U.S. Cl. ..... 439/752; 439/839; 439/843; 439/752.5; 439/852

[58] Field of Search ..... 439/851, 843, 439/842, 839, 833, 852, 752, 595, 347, 587, 599, 357, 82

[56] References Cited

U.S. PATENT DOCUMENTS

| | | | |
|---|---|---|---|
| 3,910,663 | 10/1975 | Winger | 439/82 |
| 4,540,235 | 9/1985 | Lolic . | |
| 4,550,972 | 11/1985 | Romak | 439/851 |
| 4,923,416 | 5/1990 | Zinn . | |
| 5,044,991 | 9/1991 | Colleran et al. . | |
| 5,116,236 | 5/1992 | Colleran et al. . | |
| 5,188,545 | 2/1993 | Hass et al. | 439/851 |
| 5,338,229 | 8/1994 | Egenolf | 439/839 |

FOREIGN PATENT DOCUMENTS

| | | |
|---|---|---|
| 0114187 | 8/1984 | European Pat. Off. . |
| 0333988 | 9/1989 | European Pat. Off. . |
| 0352871 | 1/1990 | European Pat. Off. . |
| 0484700 | 5/1992 | European Pat. Off. . |
| 2220310 | 1/1990 | United Kingdom . |

*Primary Examiner*—Neil Abrams
*Assistant Examiner*—Brain J. Biggi
*Attorney, Agent, or Firm*—Greenblum & Bernstein P.L.C.

[57] ABSTRACT

Female electric contact member includes a first part having crimping lugs at one end extended by a profiled part in turn extended by a body ending in two elastic bars which form a clamp for gripping a corresponding male electric contact. A complementary part fixed to the body includes two elastic bars to strengthen the elastic action of the bars. The body of the first part has a circular cross-section, the complementary part having a corresponding circular cross-section and, along each of two opposite edges which are contiguous after bending, a lug adapted to be inserted in a slot in the body of the first part and a cut-out lug at an intermediate point of its surface which is inserted in a slot of the first part.

18 Claims, 14 Drawing Sheets

FIG.36
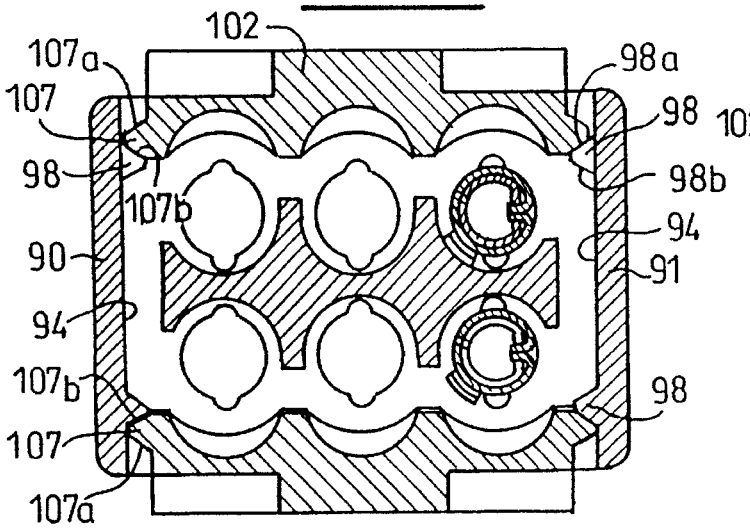
FIG.37
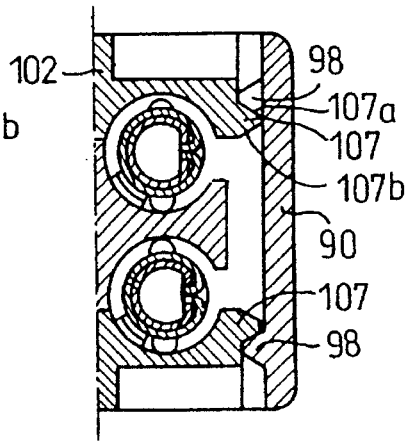
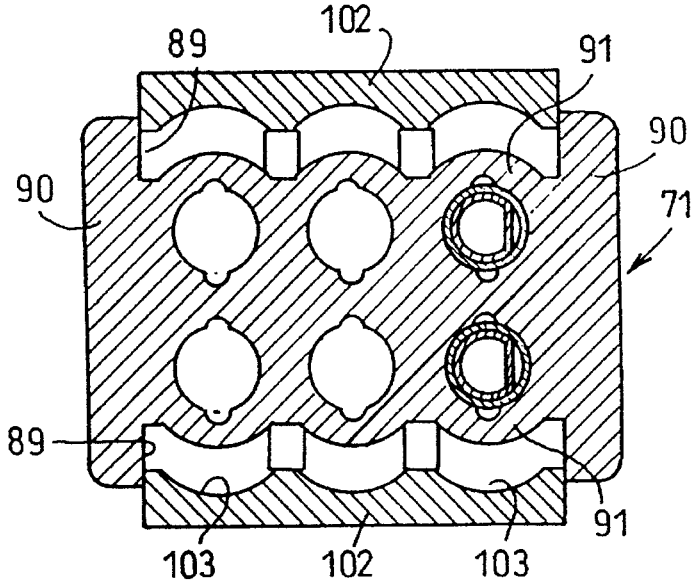
FIG.38

FEMALE ELECTRIC CONTACT MEMBER AND ELECTRIC CONNECTOR CASING ELEMENT ADAPTED TO RECEIVE SAME

BACKGROUND OF THE INVENTION

1. Field of the Invention

The present invention concerns a female electric contact member and an electric connector casing element adapted to receive same.

2. Description of the Prior Art

The invention is aimed at female electric contact members which include an elastic clamp adapted to grip a male member and whose elastic action is reinforced by a complementary element mounted on the first element and having elastic bars pressing on the branches of the clamp.

One object of the invention is to provide a member of this kind which is easy to manufacture, which can be easily accommodated in a casing element and which provides a good electrical connection.

The invention is also aimed at a connector casing element adapted to receive such members and of the type in which retractable locking means are provided to facilitate insertion of the members, these means being locked after insertion of the members in order to oppose inadvertent withdrawal of the members.

SUMMARY OF THE INVENTION

In one aspect the invention consists of a female electric contact member and casing element adapted to receive a member of this kind, the member being of the type comprising a first element cut out and bent to shape from a strip of metal that is a good conductor of electricity and has some elasticity, the strip having at one end crimping lugs extended by a profile part in turn extended by a body terminated by two elastic bars adapted to form a clamp to grip a corresponding male electric contact member and a complementary element fixed to the body and cut out and bent to shape from a strip of a metal that is a good conductor of electricity and has some elasticity, the strip being adapted to receive the body of the first element and having two elastic bars adapted to bear against the elastic bars of the first element to strengthen the elastic action of the latter and a retaining flap whose free end faces towards the crimping lugs, whereas the casing element is of the type adapted to cooperate with a complementary casing element containing male electric contact members, the casing element having channels each adapted to receive a female electric contact member, means being provided for locking the members, the means being adapted to occupy a first or ready position in which the female electric contact members can be fitted and a second or locking position in which the female electric contact members are immobilized, the body of the first element having a circular cross-section, the complementary element having a corresponding circular cross-section and the elastic bars of the first element being flat.

With this arrangement, and without significant modification to the tooling, it is possible to manufacture female electric contact members which can cooperate either with flat male members or with cylindrical male members.

In one specific embodiment of the invention, the complementary element has along each of two opposite edges adapted to be contiguous after bending a lug adapted to be bent inwards so as to be inserted into a slot of the body of the first element and opening between the two elastic bars and a cut-out lug at an intermediate point of its surface adapted to be bent inwards to be inserted into a notch along the length of the first element and cut out from one edge of the body adapted to be contiguous with the opposite edge after bending of the body.

In a second specific embodiment of the invention, the body has a flat part in which there is a cut-out lug cooperating with the inside surface of the complementary element.

In a third specific embodiment of the invention, the elastic bars of the first element terminate at lips passing through notches in the corresponding end of the complementary element.

In a fourth specific embodiment of the invention, the complementary element has near its free end at least two angularly offset lateral bosses.

In a fifth specific embodiment of the invention, the complementary member has on each of two opposite sides adapted to be contiguous after bending a respective lug adapted to bear against projections on the corresponding edges of the elastic bars to hold them apart.

In a sixth specific embodiment of the invention, the channels of the casing element open into an open part in the back of which are imprints corresponding to the shape of the female electric contact members, the open parts being delimited by an end wall adapted to limit insertion of the female electric contact members and having therein holes for male electric contact members, the open part being delimited by lateral walls having grooves on their inside surface to guide lugs of a key having on its side adapted to face towards the imprints complementary imprints corresponding to the shape of the female electric contact members, means being provided for holding the key in a ready position in which its imprints are away from the imprints in the bottom of the casing element to enable insertion of the female electric contact members and, when the latter are fitted, for displacing the key towards a locking position in which the female electric contact members are gripped between the imprints.

The side walls are preferably joined at a point partway along their length by a bridge forming an abutment for the retaining flap of the female electric contact member.

In a seventh specific embodiment of the invention, each side wall has on its inside surface three grooves, the middle groove having an abutment with inclined ramp surfaces so that it can be passed, whereas the other two grooves include hooks with non-inclined sides facing towards the groove bottom, the key having lugs on two opposite edges adapted to cooperate with the non-inclined sides of the hooks and the abutments with inclined ramp surfaces, the position of the hooks, lugs and abutments being such that when the lugs bear against the non-inclined sides of the hooks the abutments of the key bear against a ramp surface of the abutments of the grooves, the key being in a ready position, whereas when the abutments of the key have passed the abutments, the key is in a locking position.

In an eighth specific embodiment of the invention, the channels include two screwthread parts at their entry end opening into longitudinal channels.

Accordingly, when the female electric contact member is provided with flat elastic bars to receive a flat male member, for example, with a rectangular or square cross-section, it is certain that the female member will have an angular position compatible with insertion of the male member.

In a ninth specific embodiment of the invention, the casing element is extended at the end adjacent the channels by a skirt into which is inserted a gasket in which are holes or openings aligned with the channels.

When the female member is inserted in the casing element, given its generally cylindrical shape, there is no risk of damaging the gasket.

In a tenth specific embodiment of the invention, the casing element has two open parts on two opposite sides and each adapted to receive a key.

The invention will now be described in more detail with reference to specific embodiments of the invention shown by way of example only in the appended drawings.

BRIEF DESCRIPTION OF THE DRAWINGS

FIG. 36 is a view in section on the line 36—36 in FIG. 29.

FIG. 37 is a view corresponding to FIG. 36 showing the keys locked.

FIG. 38 is a view in section on the line 38—38 in FIG. 29.

DESCRIPTION OF THE PREFERRED EMBODIMENTS

Figure 1:
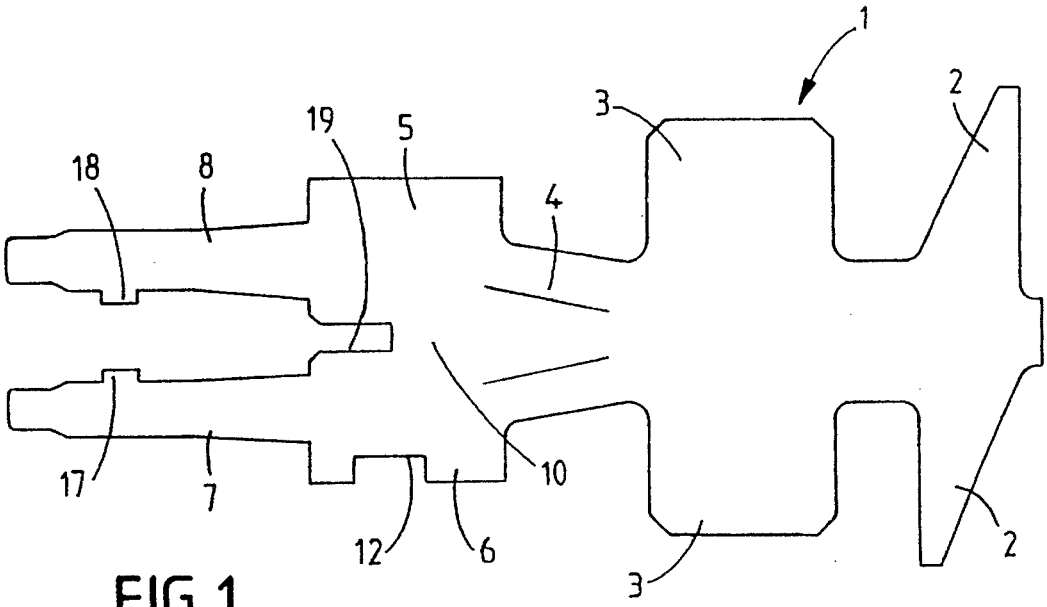
FIG. 1 is a plan view showing the blank for the first element of an electric contact member of the invention.
Figure 2:
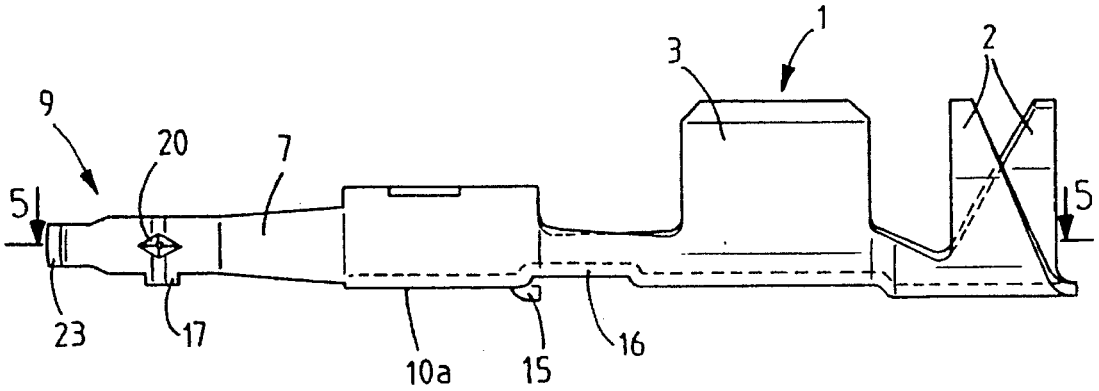
FIG. 2 is an elevation view of the first element of the electric contact member made from the blank shown in FIG. 1.
Figure 3:
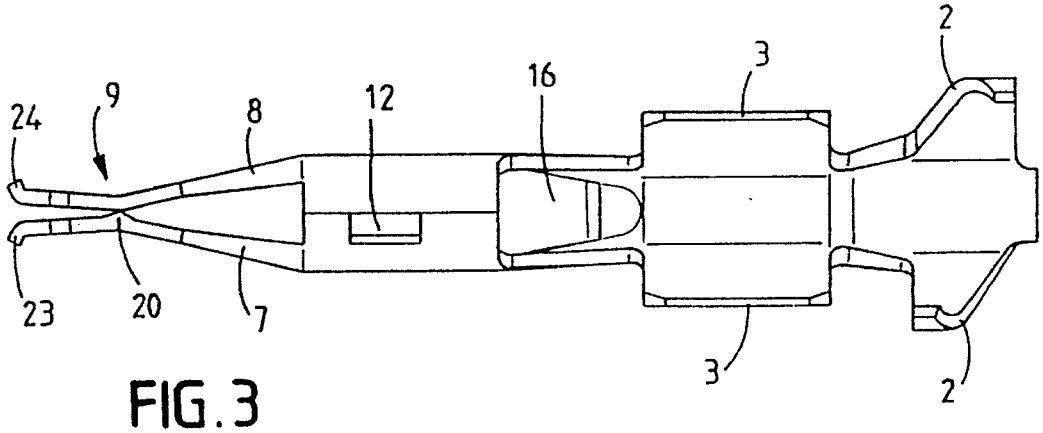
FIG. 3 is a top view.
Figure 4:
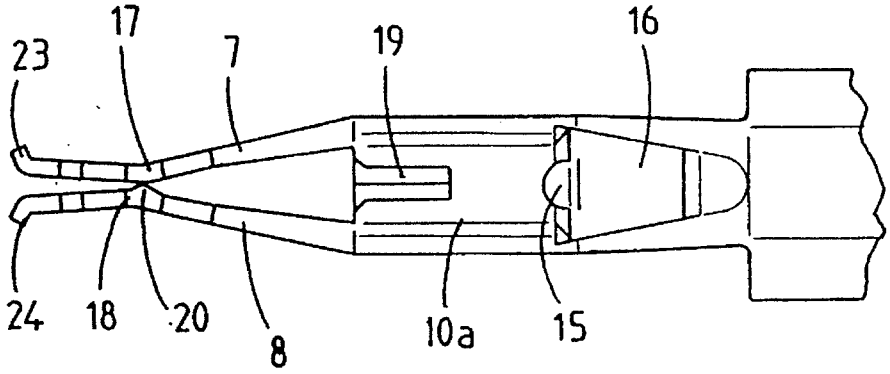
FIG. 4 is a bottom view.
Figure 5:
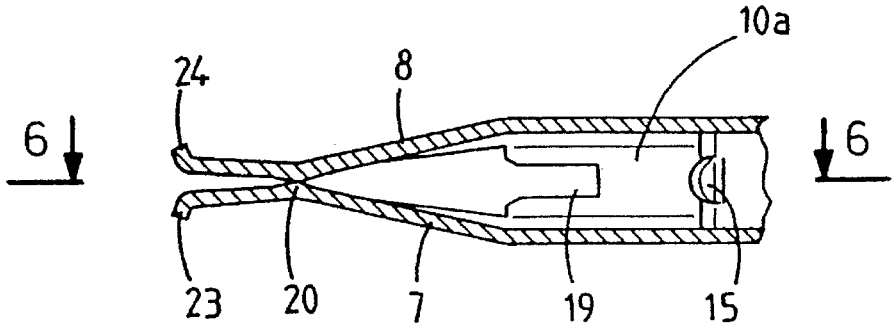
FIG. 5 is a view in section on the line 5—5 in FIG. 2.
Figure 6:
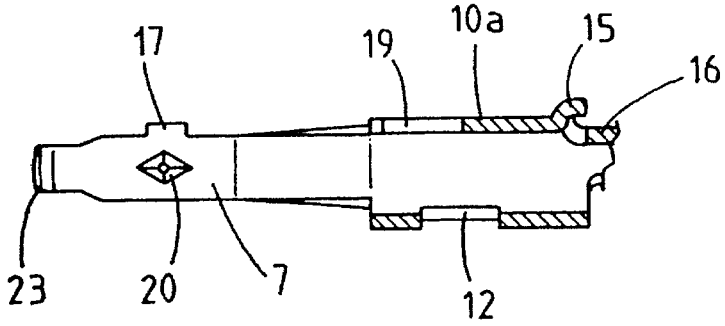
FIG. 6 is a view in section on the line 6—6 in FIG. 5.
Figure 7:
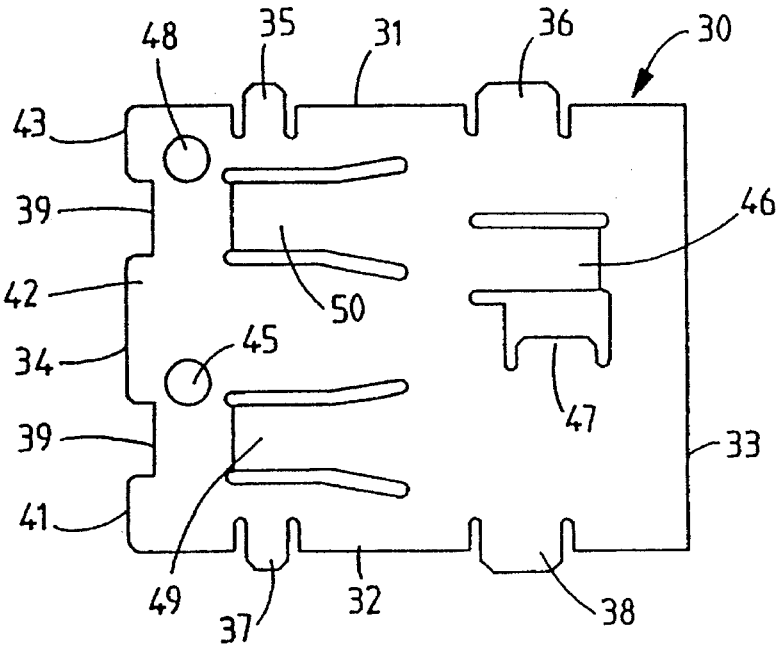
FIG. 7 is a plan view showing the blank of the complementary element of the electric contact member.
Figure 8:
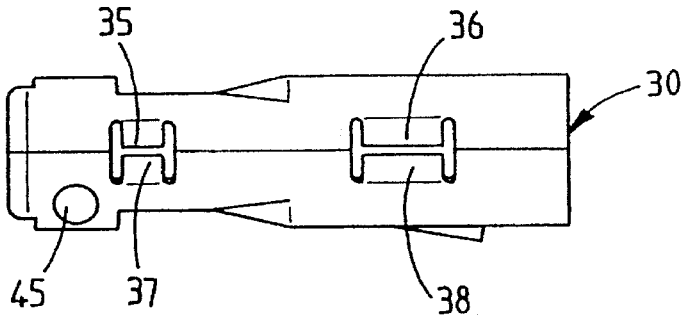
FIG. 8 is a top view of the complementary element made from the blank shown in FIG. 7.
Figure 9:
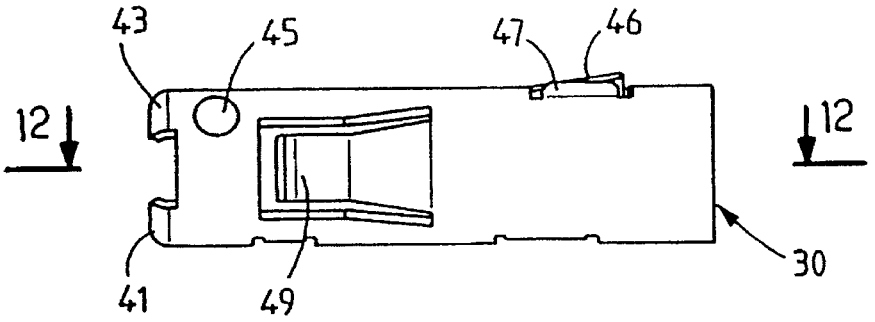
FIG. 9 is an elevational view.
Figure 10:
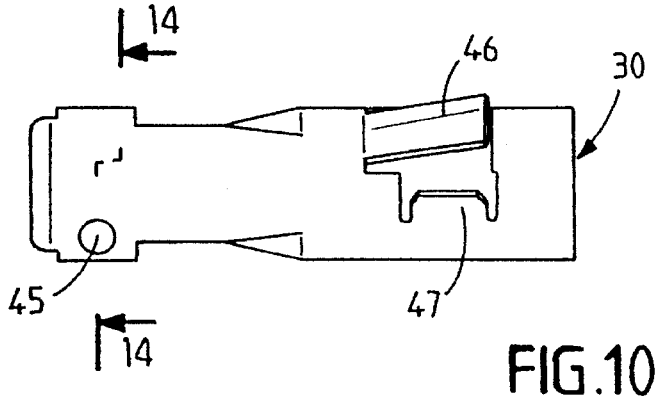
FIG. 10 is a bottom view.
Figure 11:
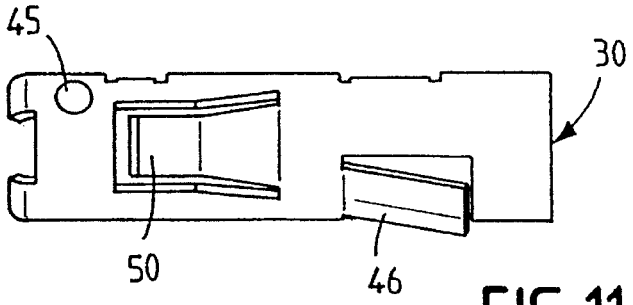
FIG. 11 is an elevational view.
Figure 12:
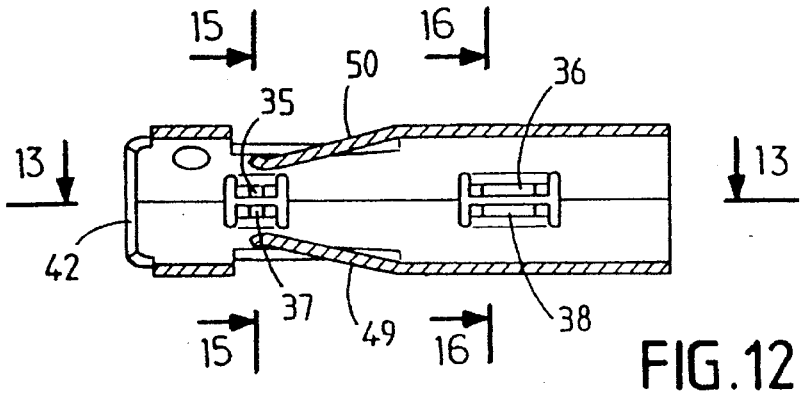
FIG. 12 is a view in section on the line 12—12 in FIG. 9.
Figure 13:
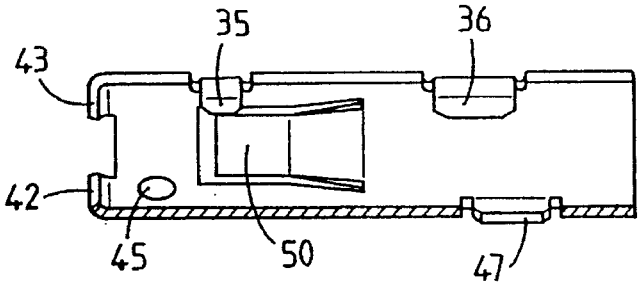
FIG. 13 is a view in section on the line 13—13 in FIG. 12.
Figure 14:
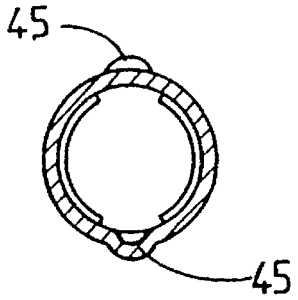
FIG. 14 is a view in section on the line 14—14 in FIG. 10.
Figure 15:
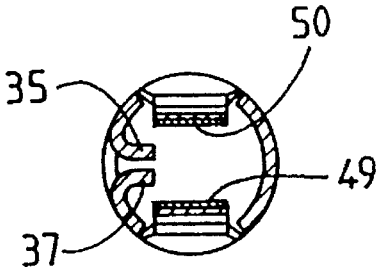
FIG. 15 is a view in section on the line 15—15 in FIG. 12.
Figure 16:
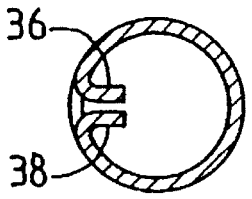
FIG. 16 is a view in section on the line 16—16 in FIG. 12.
Figure 17:
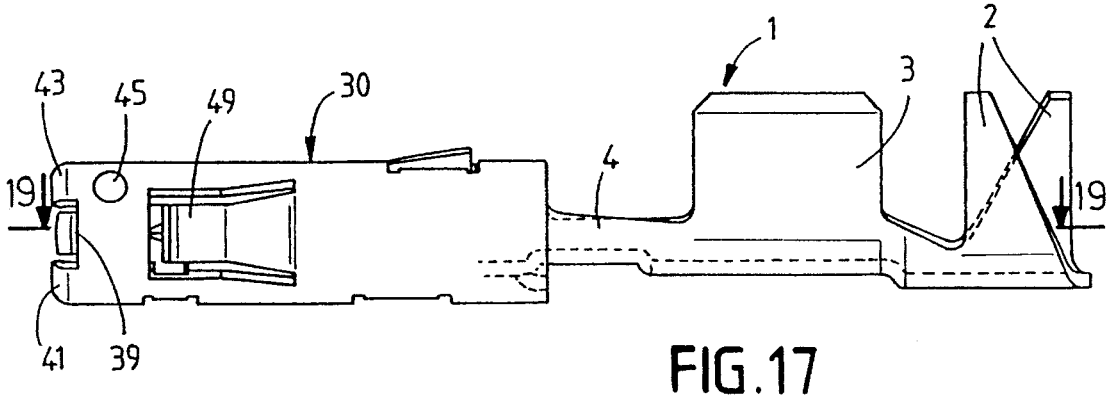
FIG. 17 is a view in elevation of the electric contact member with the two elements assembled together.
Figure 18:
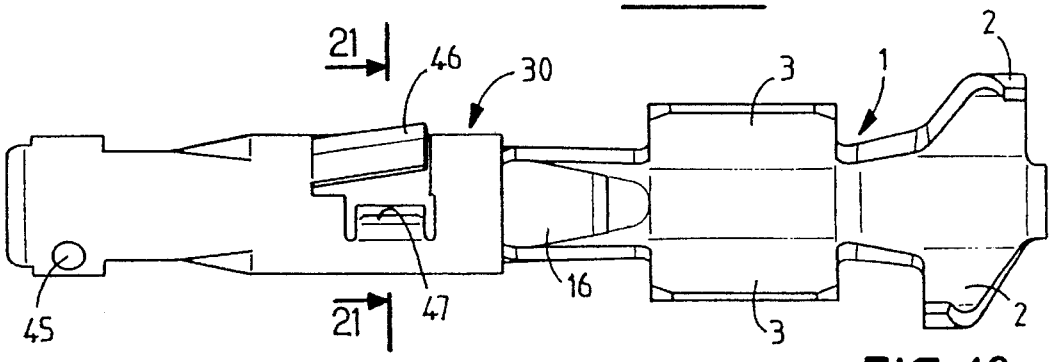
FIG. 18 is a plan view.
Figure 19:
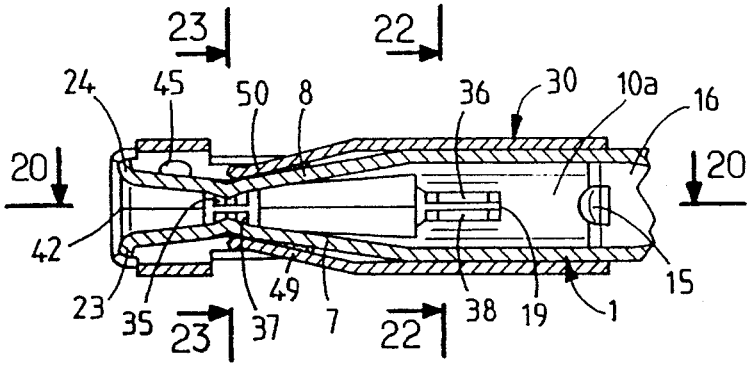
FIG. 19 is a view in section on the line 19—19 in FIG. 17.
Figure 20:
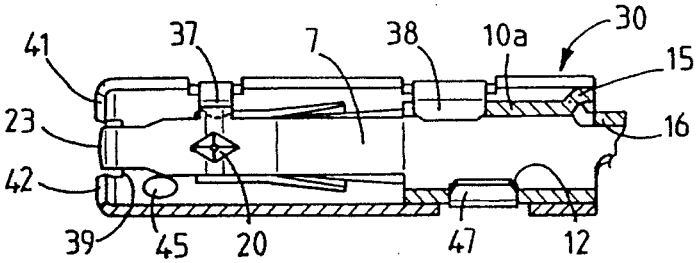
FIG. 20 is a view in section on the line 20—20 in FIG. 19.
Figure 21:
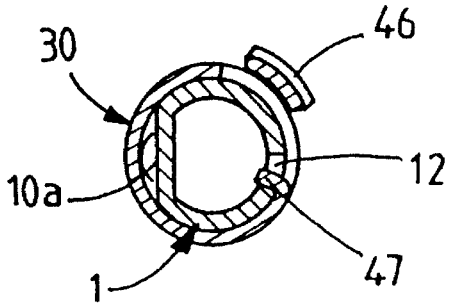
FIG. 21 is a view in section on the line 21—21 in FIG. 18.
Figure 22:
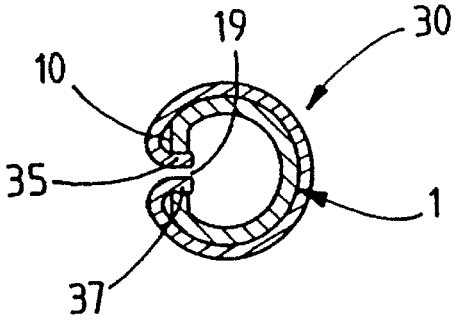
FIG. 22 is a view in section on the line 22—22 in FIG. 19.
Figure 23:
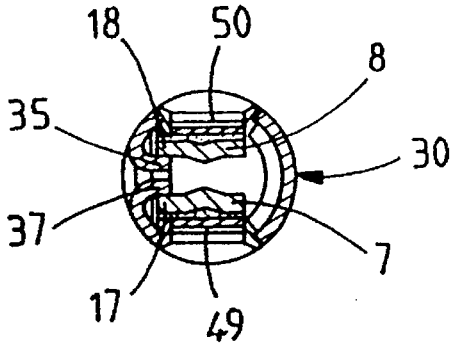
FIG. 23 is a view in section on the line 23—23 in FIG. 19.
Figure 24:
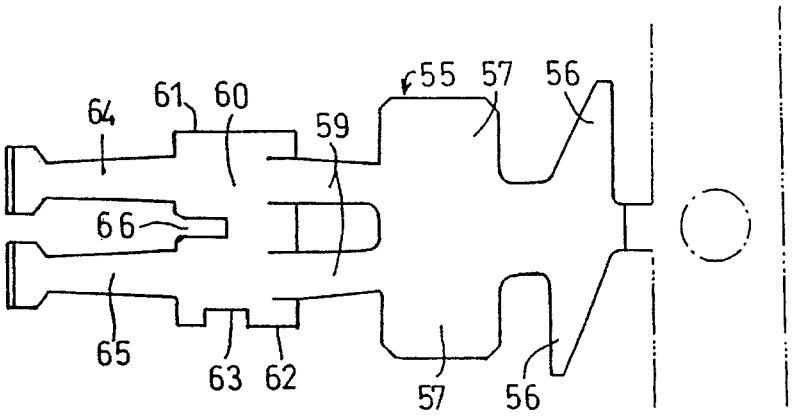
FIG. 24 is a plan viewing showing the blank of an alternative embodiment of the first element.
Figure 25:
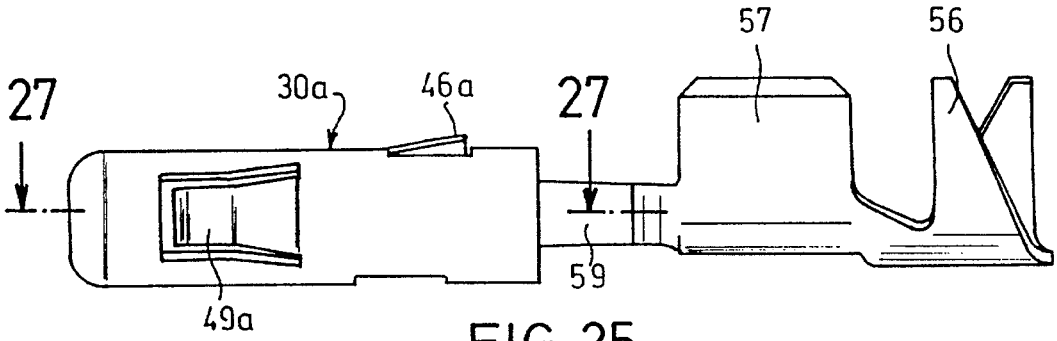
FIG. 25 is a view in elevation of this second embodiment of the electric contact member.
Figure 26:
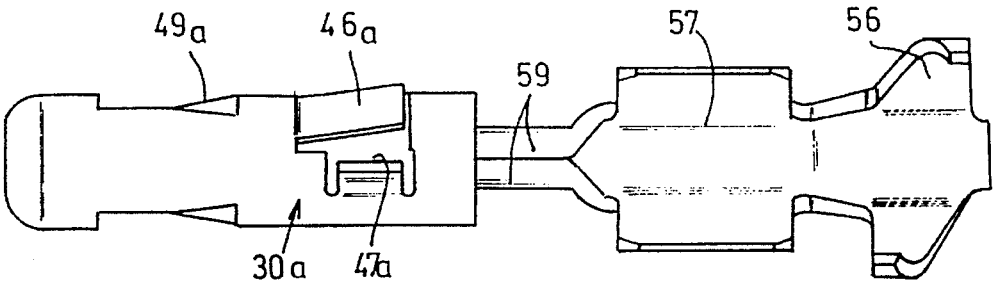
FIG. 26 is a corresponding plan view.

The first element of the electric contact member shown in FIGS. 1 to 6 is cut and bent to shape from a strip of metal that is a good conductor of electricity and has some elasticity.

The first element 1 has at one end two crimping lugs 2 adapted to grip an insulated electric conductor. Near the lugs 2 is a second pair of crimping lugs 3 adapted to grip a bared part of the electric conductor.

At the end opposite the lugs 2, the element 1 has two elastic bars 7, 8 adapted to form a clamp 9 to grip a male conductor in the form of a flat tongue.

Between the bars 7 and 8 and the lugs 3 are a part 10 and a part 4.

The part 10 is adapted to be rolled to form a body with a flat bottom 10*a* extended by two arcuate parts whose edges 5 and 6 are contiguous, the edge 6 including a notch 12.

The part 4 has a profile including a stiffening rib 16 and a lug 15 projecting from the outside surface of the flat bottom 10*a*.

The flat bottom 10*a* has a slot 19 in it at the same end as the elastic bars 7 and 8. The bars 7 and 8 have respective projections 17 and 18 facing towards the flat bottom 10*a*.

The bars 7 and 8 are curved to form a contact point at which there is a boss 20.

The free end of the bar 7 has an outward lip 23 and the free end of the bar 8 has a corresponding lip 24.

FIGS. 7 through 16 show the complementary element adapted to be mounted on the first element 1.

The complementary element 30 is cut out and bent to shape from a strip of metal that is a good conductor of electricity and has some elasticity.

The blank when cut out from this metal strip has a generally rectangular shape with two longer sides 31 and and two shorter sides 33 and 34.

The longer side 31 has slots in it delimiting two lugs 35 and 36. The longer side 32 has corresponding lugs 37 and 38.

The shorter side 34 has two large notches 39 in it delimiting abutments 41, 42 and 43.

Near the shorter side or free end 34 are two circular stamped areas 45 and 48 adapted to form bosses on the lateral surface which are angularly offset.

A retaining tongue or flap 46 parallel to the longer sides 31 and 32 and near the shorter side 33 has its free edge facing towards the shorter side 33.

There is a lug 47 near one edge of the retaining tongue or flap 46.

Finally two bars 49 and 50 reinforce the elastic action of the bars 7 and 8.

The complementary element is rolled to form a cylinder with the two longer sides 31 and 32 contiguous.

FIGS. 17 through 23 show the fitting and joining together of the two elements 1 and 30.

The complementary element 30 is fitted over the corresponding end of the element 1 so that the lugs 36 and 38 are inserted into the slot 19 and the lug 47 is engaged in the slot formed by the notch 12.

In this position the bar 50 bears against the bar 8 and the bar 49 cooperates with the bar 7.

The lugs 35 and 37 are bent inwards to bear against the mutually facing sides of the projections 17, 18, while the lips 23 and 24 are located facing the notches 39.

The abutments 41 and 42 delimit the width of the space available for inserting a male tongue and oppose the insertion of an oversize tongue.

The lug 15 abuts against the inside surface of the complementary element 30 to take up play between the flat part 10*a* and the complementary element 30.

The depth of the notches 39 complements the abutments 41 and 42 by delimiting the range of movement of the elastic bars 7 and 8.

Finally, cooperating with the projections 17 and 18, the lugs 35 and 37 separate the bars 7 and 8 to facilitate insertion of the male tongue.

In the embodiment of the invention shown in FIGS. 24 to 28 the second element of the electric contact member is substantially identical to that described and shown in previous FIGS. 1 to 23 and the reference numbers used to identify it and its various component parts in these figures are those used in the previous figures to denote the corresponding parts, with the suffix "a" added.

The first element 55 of this embodiment of the invention has two pairs of crimping lugs 56 and 57, the lugs 57 being extended by bars 59 attached to a part 60 attached to two elastic bars 64 and 65.

The bars 59 are adapted to be bent and rolled to form a cylindrical part adjoining a cylindrical part formed by bending and rolling the part 60 whose edges 61 and 62 are contiguous, the edge 62 including a notch 63 adapted to form a slot.

The elastic bars 64 and 65 are bent so that they have concave sides facing each other.

A slot 66 is formed in the part 60.

Figure 27:
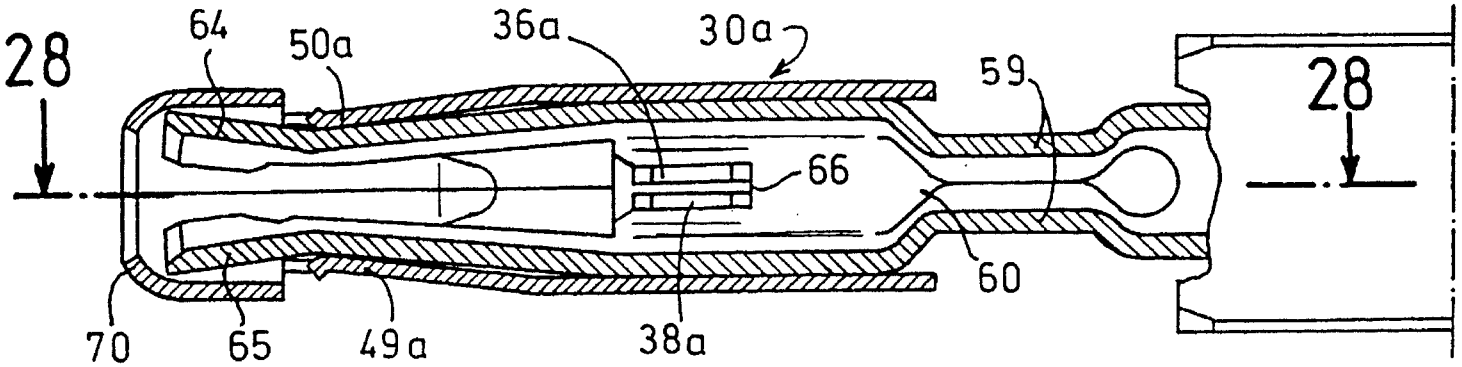
FIG. 27 is a view in section on the line 27—27 in FIG. 25.
Figure 28:
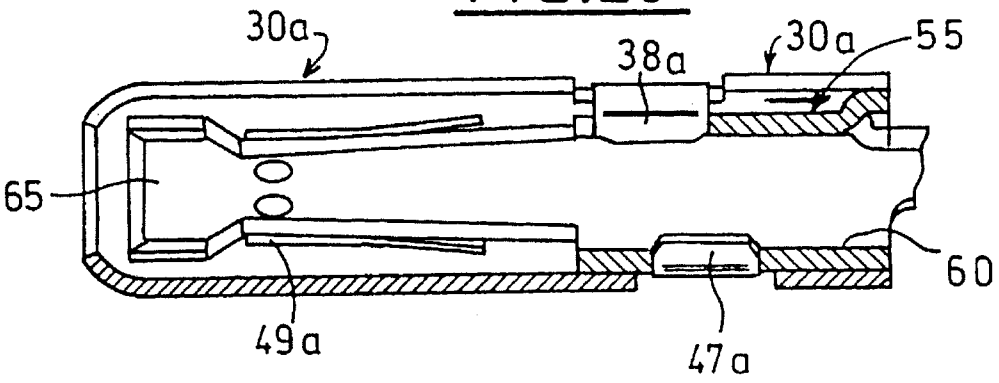
FIG. 28 is a view in section on the line 28—28 in FIG. 27.
Figure 29:
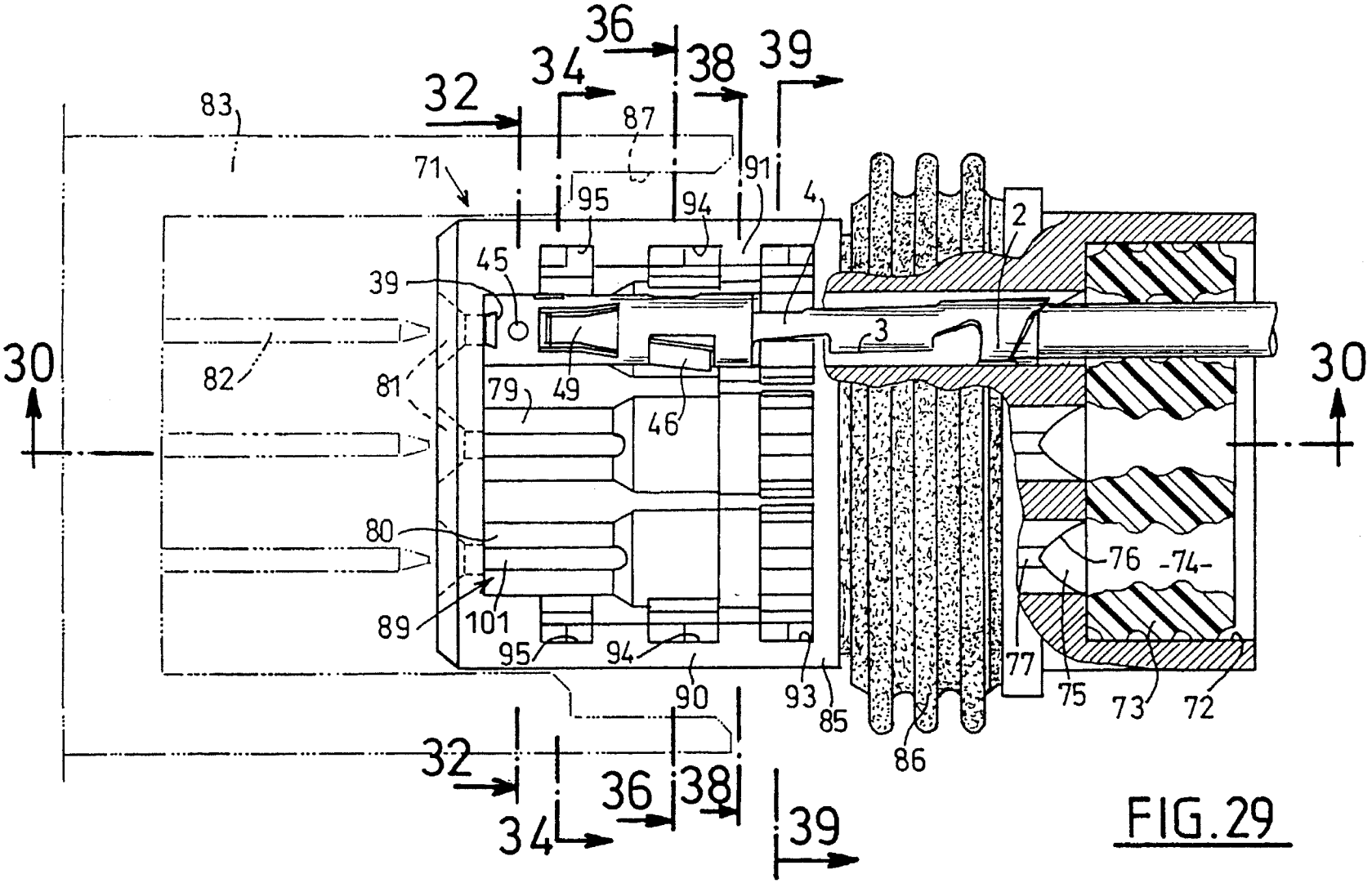
FIG. 29 is a view in elevation of a casing element adapted to receive an electric contact member from the preceding figures.
Figure 31:
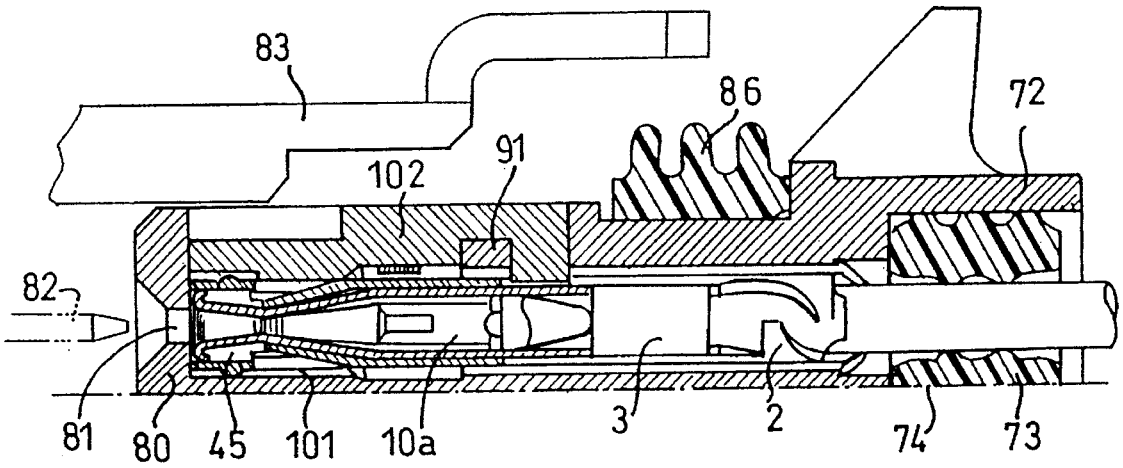
FIG. 31 is a view corresponding to FIG. 30 showing one of the keys in the locked position.
Figure 30:
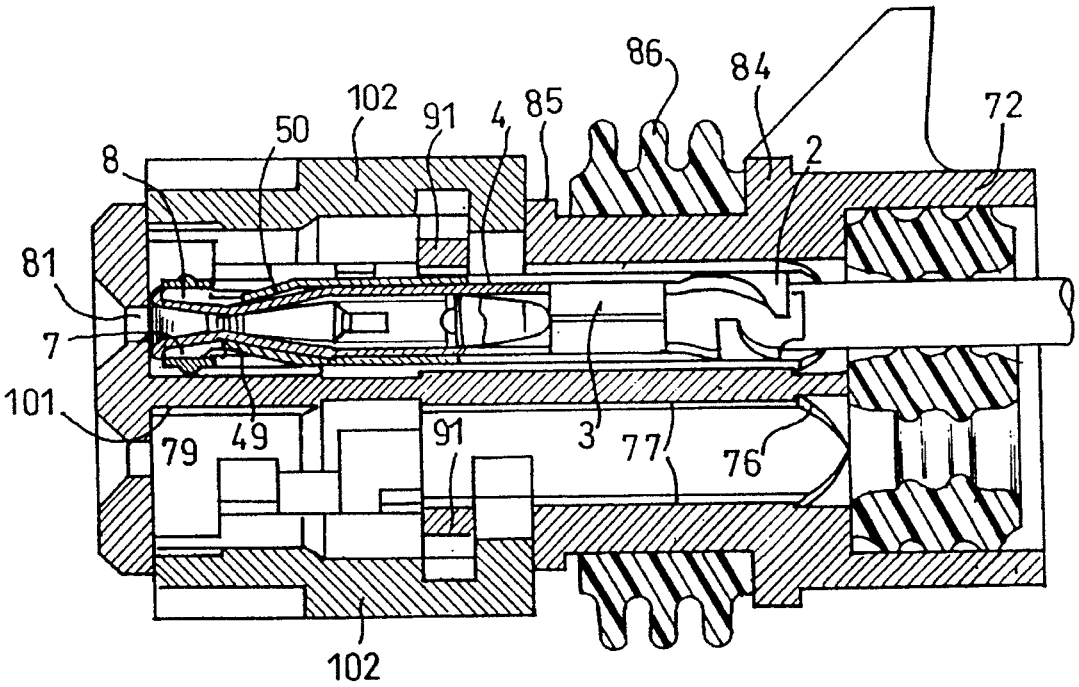
FIG. 30 is a view in section on the line 30—30 in FIG. 29.
Figure 32:
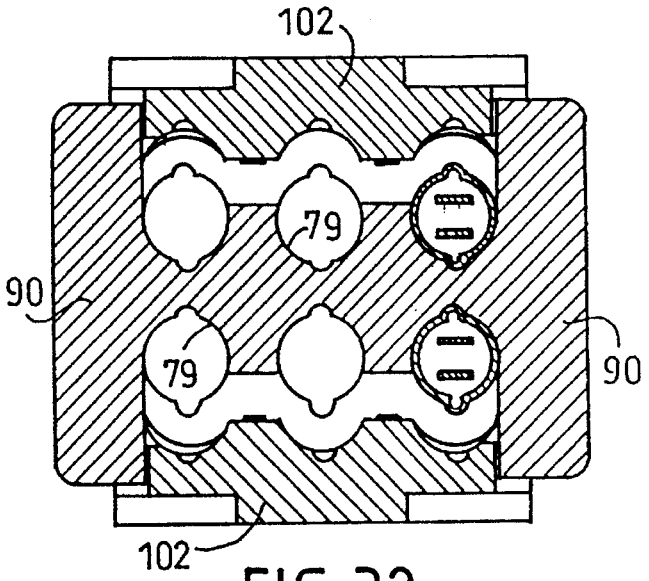
FIG. 32 is a view in section on the line 32—32 in FIG. 29 showing the keys in a ready position.
Figure 33:
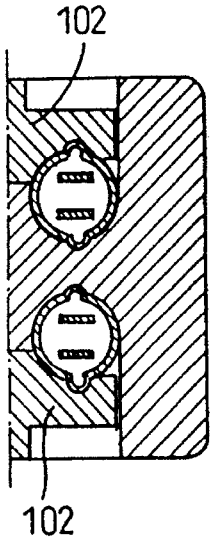
FIG. 33 is a view corresponding to FIG. 32 showing the keys locked.
Figure 34:
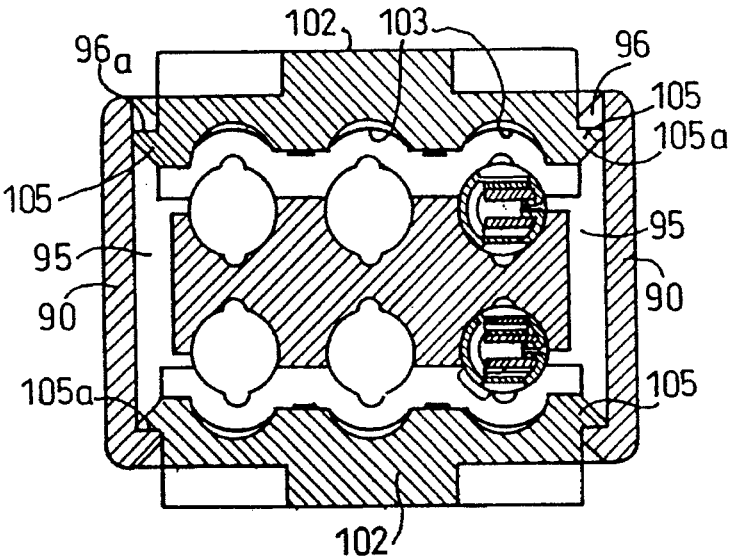
FIG. 34 is a view in section on the line 34—34 in FIG. 29.
Figure 35:
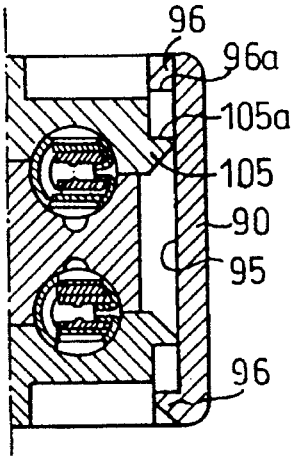
FIG. 35 is a view corresponding to FIG. 34 showing the keys locked.
Figure 40:
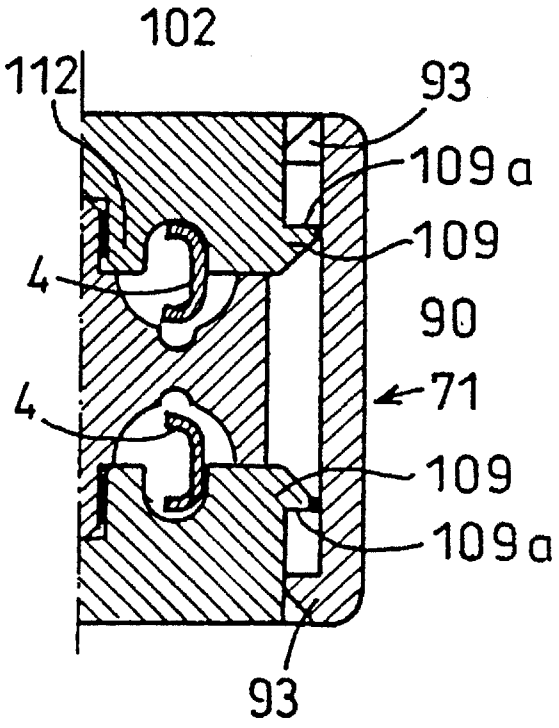
FIG. 40 is a view corresponding to FIG. 39 showing the keys locked.
Figure 39:
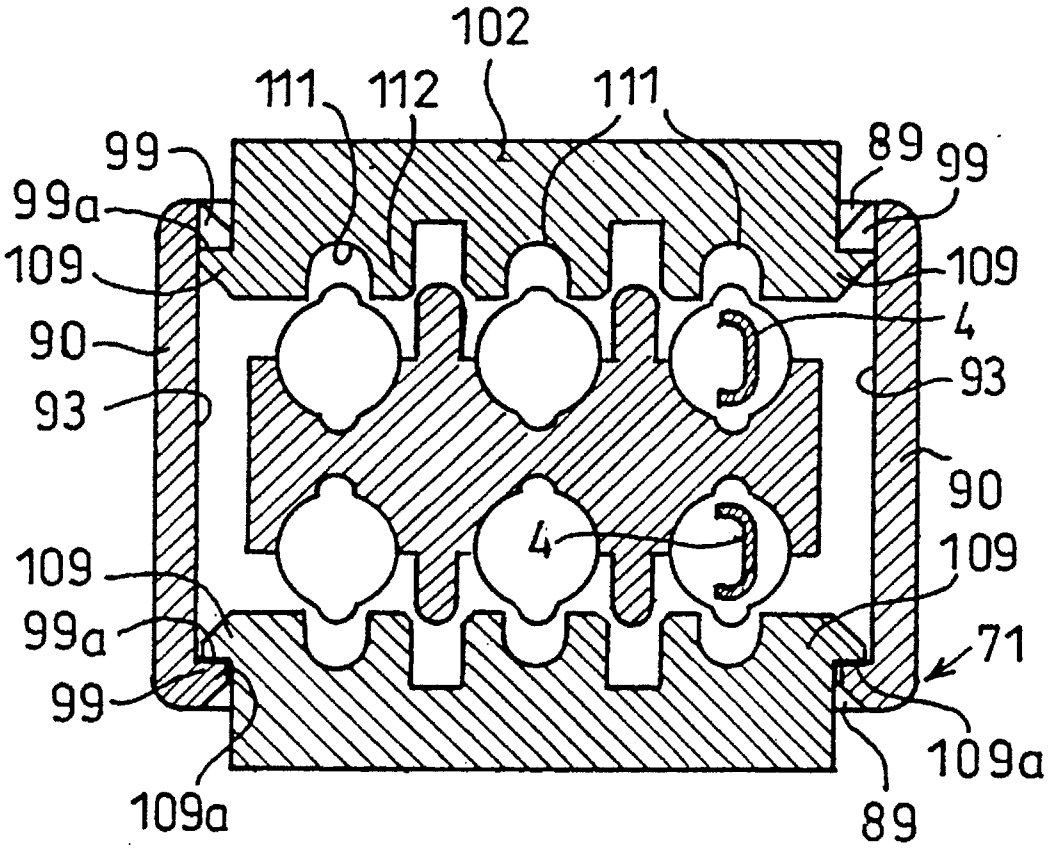
FIG. 39 is a view in section on the line 39—39 in FIG. 29.

The electric contact member 55 is adapted to receive a cylindrical cross-section male member 70 (see FIG. 27).

A second element 30*a* is mounted and fixed on the element 55. It has lugs 36*a*, 38*a* adapted to be inserted into the slot 66, a lug 47*a* engaging in the slot 63 and two bars 49*a* and 50*a* adapted to strengthen the elastic action of the elastic bars 65 and 64, respectively.

The second element 30*a* has a retaining tongue or flap 46*a* and there are no notches 39 at its free end, as in the embodiment of the invention shown in FIGS. 7 through 11, the result of which is that the free ends of the elastics bars 64 and 65 can abut against the inside surface of the second element 30*a* when they are separated to oppose the insertion of a male member 70 of the wrong size.

FIGS. 29 to 40 show a casing element 71 adapted to receive electric contact members such as those described with reference to the previous figures.

The casing element 71 is extended at one end by a skirt 72 adapted to receive a gasket 73 comprising a flexible elastic block having a series of holes or opening 74 with corrugated lateral surfaces, each hole facing a channel having an entry end 75.

The entry end of each channel 75 has two screwthread sections 76 each subtending an angle of 180° and each leading to a longitudinal channel 77.

Each channel 75 opens into an open part 89 comprising a back portion in the bottom of which are first imprints or recesses 79. In the embodiment of the invention shown, there are six imprints or recesses 79, three facing one side and three facing the opposite side, the imprints being closed by an end wall 80 with holes 81 in it for flat male members 82 fastened to a complementary casing element 83 adapted to receive the casing element 71.

The casing element 71 has two beads 84 and 85 adapted to retain a gasket 86 inserted into an extension 87 of the complementary casing element 83.

The end wall 80 is attached to two side walls 90 which are attached to the bead 85.

The side walls comprising a length are linked at each end by a bridge 91 whose side facing the wall 80 constitutes an abutment for the retaining tongues 46.

The walls 90 have grooves 93, 94 and 95 on their inside surfaces.

Retaining hooks 96 are provided in the grooves 95, at each end, with their non-inclined sides 96*a* facing each other and towards the inside of the respective grooves.

Abutments 98 are provided in the grooves 94, near the ends of the latter, having two inclined ramp surfaces 98*a* and 98*a*. These abutments are offset towards the inside of the grooves relative to the hooks 96.

The grooves 93 have hooks 99 at each end whose non-inclined sides 99*a* face towards the inside of the grooves.

Each imprint 79 or recess is the shape of the first embodiment of electric contact member in accordance with the invention. A channel 101 near the end wall 80 extends the channel 77.

Two locking keys 102 are provided. Each key 102 has three second imprints or recesses 103 corresponding to the first imprints 79 so that it is able to cooperate with the electric contact members and immobilize them.

Each key 102 has along two opposite longitudinal edges a lug 105 adapted to cooperate with the grooves 95, an abutment 107 adapted to be inserted into the grooves 94 and a lug 109 adapted to be guided in the grooves 93.

Each lug 105 has a non-inclined side 105*a* facing in the opposite direction to the corresponding non-inclined side 96*a* of the hook 96.

The abutments 107 are the same shape as the abutments 98 and include ramp surfaces 107*a* and 107*b*. The lugs 109 have a non-inclined side 109*a* facing in the opposite direction to the non-inclined sides 99*a*. The part of each key 102 between two lugs 109 of two opposite sides includes teeth 112 linked by convex parts 111.

The keys 102 have two positions, namely a ready position and a locking position.

FIGS. 32, 34, 36, 38 and 39 show the ready position. FIGS. 33, 35, 37 and 40 show the locking position.

The electric contact member is first inserted in a hole 74. Because of its cylindrical external shape, it does not damage the side walls of the hole 74 in the gasket. The two angularly offset bosses 45 encounter the two screwthread portions 76 which automatically modify the angular position of the member so that the bosses align with the channels 77. The electric contact member is pushed in until its free end abuts against the end wall 80 (see FIG. 31). In this position the retaining flap 46 (which retracted elastically when the contact member was first inserted) projects and opposes withdrawal of the member by abutting against the bridge 91. One of the bosses 45 is guided in the channel 101 so that the member is held in the correct angular position to receive a flat male member 82 which can have a rectangular or square cross-section.

When fitting the female electric contact members, the keys 102 are left in the ready position, in which the lugs 109 have passed beyond the hooks 99 and the lugs 105 have likewise passed beyond the hooks 96 (see FIGS. 32, 34) so that the keys cannot become separated unintentionally. On the other hand, the ramp surfaces 107*b* of the abutments 107 bear against the ramp surfaces 98*a* of the abutments 98 (see FIG. 36) so holding the imprints 103 of the keys 102 away from the corresponding imprints 79.

When the female electric contact members have all been fitted, the two keys 102 are depressed so that the abutments 107 pass beyond the abutments 98. In this position the female electric contact members are trapped, the teeth 112 between the bridge 91 and the bead 85 taking up positions on either side of the part 4 so that they form an abutment opposing withdrawal of the members by cooperation with the edge of the second element 30 adjacent the lugs 3.

In the embodiment of the casing of the invention shown in FIGS. 29 to 40, the casing element is adapted to receive a female contact member like that described with reference to FIGS. 1 to 24 as the members must be oriented precisely to be able to receive the male members 82. Note that the female electric contact member shown in FIGS. 25 to 28 does not need to be in a specific orientation, because it is adapted to receive circular cross-section male members; for this reason it does not include any bosses 45. Accordingly, the member shown in FIGS. 25 to 28 can be fitted into the casing element 71 without difficulty and then locked in place by the keys 102.

It is to be understood that it is possible, without significant modification to the tooling, to fabricate female electric contact members adapted to receive flat male members (FIGS. 1 to 24) or cylindrical male members (FIGS. 25 to 28).

Of course, the invention is not limited to the embodiments shown and described. Numerous modifications of detail may be made thereto without departing from the scope of the invention.

There is claimed:

1. In combination, female electric contact members and a casing element adapted to receive said female electrical contact members;

each female electric contact member comprising:

a first element cut out and bent to shape from a first metal strip that is a good conductor of electricity and comprising some elasticity, said first element including a body comprising at one end crimping lugs extended by a profile part that is in turn extended by a body terminated by two first elastic bars adapted to form a clamp to grip a corresponding male electric contact member, wherein said body of said first element comprises a circular cross-section and said two first elastic bars are flat; and a complementary element cut out and bent to shape from a second metal strip that is a good conductor of electricity and comprising some elasticity, and being adapted to receive and be fixed to said body of said first element, said complementary element including two second elastic bars adapted to bear against said two first elastic bars of said first element to strengthen elastic action of said two first elastic bars, and a retaining flap comprising a free end facing towards said crimping lugs, wherein said complementary element comprises a corresponding circular cross-section and a free end, where in the vicinity of the free end, there is at least one boss; and said casing element being adapted to cooperate with a complementary casing element, said complementary casing element containing male electric contact members, and said casing element comprising:

a plurality of channels, each of said plurality of channels adapted to receive a female electric contact member and each of said plurality of channels comprising at least one groove for guiding at least one boss of said complementary element; and means for locking each said female electric contact member, said means for locking occupying a first, ready position in which each said female electric contact member can be fitted into a corresponding channel, and a second, locking position in which each said female electric contact member is immobilized.

2. The combination according to claim 1, wherein said complementary element includes, along each of two opposite edges adapted to be contiguous after bending, a lug adapted to be bent inwards so as to be inserted into a slot of said body of said element and opening between said two first elastic bars, and a first cut-out lug at an intermediate point of a surface of said complementary element adapted to be bent inwards to be inserted into a notch along a length of said body of said first element, said notch being cut out from one edge of said body and adapted to be contiguous with an opposite edge of said body after bending of said body.

3. The combination according to claim 1, wherein said complementary element comprises an inside surface, and said body of said first element comprises a flat part including a cut-out lug cooperating with said inside surface.

4. The combination according to claim 1, wherein said first two elastic bars of said first element terminate at lips passing through notches in a corresponding end of said complementary element.

5. The combination according to claim 1, wherein said complementary element comprises at least two lateral bosses near a free end, said bosses being angularly offset at an angle of 180°.

6. The combination according to claim 1, wherein said complementary element comprises on each of two opposite sides, adapted to be contiguous after bending, a respective lug adapted to bear against projections on corresponding edges of said first two elastic bars to hold said first two elastic bars apart.

7. The combination according to claim 1, wherein said plurality of channels of said casing element open into an open part comprising a back portion including first recesses corresponding to a shape of a corresponding female electric contact member; said open part being delimited by an end wall adapted to limit insertion of said female electric contact members and comprising openings for male electric contact members; a key comprising lugs and second recesses corresponding in shape to said first recesses; said open part being further delimited by side walls comprising a plurality of grooves on inside surfaces of said side walls to guide said lugs of said key; and means for holding said key in the ready position in which said second recesses are spaced away from said first recesses to enable insertion of said female electric contact members, and, when said female electric contact members are inserted, for displacing said key towards the locking position in which said female electric contact members are gripped between said recesses.

8. The combination according to claim 7, wherein said side walls comprise a length, and are connected at a point intermediate the length by a bridge forming an abutment for said retaining flap.

9. The combination according to claim 7, wherein said plurality of grooves comprise three grooves of which one groove comprises a middle groove; and said means for holding said key in a ready position and for displacing said key towards a locking position comprise abutments in said middle groove comprising inclined ramp surfaces so that said inclined ramp can be passed, and the other two grooves comprise hooks with non-inclined surfaces facing towards a bottom portion of said other two grooves; said lugs on said key being positioned on two opposite edges of said key adapted to cooperate with said non-inclined sides and said inclined ramp surfaces, said lugs, hooks and abutments being structured and arranged so that, when said lugs bear against said non-inclined sides of said hooks, said lugs of said key bear against said inclined ramp surfaces and said key is in the ready position, and, when said lugs of said key have passed said hooks and abutments, said key is in the locked position.

10. The combination according to claim 7, wherein said complementary element comprises at least two angularly offset lateral bosses near a free end; and said plurality of channels of said casing element include an entry end, and include two screwthread parts at said entry end opening into longitudinal channels.

11. The combination according to claim 7, wherein said casing element includes an end adjacent said plurality of channels, and said casing element is extended at said end adjacent said plurality of channels by a skirt, a gasket is positioned in said skirt, and said gasket includes openings aligned with said plurality of channels.

12. The combination according to claim 7, wherein said casing element comprises two open parts on two opposite sides, and each of said two open parts is adapted to receive a key.

13. A casing element adapted to receive a female contact member comprising a first element and a complementary element, and being adapted to cooperate with a complementary casing element containing male electric contact members, said casing element, comprising:

a plurality of channels, each of said plurality of channels adapted to receive a female electric contact member; and means for locking each female electric contact member, said means for locking occupying a first, ready position in which each female electric contact member can be fitted into a corresponding channel, and a second, locking position in which each female electric contact member is immobilized, wherein said plurality of channels of said casing element open into an open part comprising a back portion including first recesses corresponding to a shape of a female electric contact member to be inserted therein; said open part being delimited by an end wall adapted to limit insertion of the female electric contact members and comprising openings for male electric contact members; a key comprising lugs and second recesses corresponding in shape to said first recesses; said open part being further delimited by side walls comprising a plurality of grooves on inside surfaces of said side walls to guide said lugs of said key; and means for holding said key in the ready position in which said second recesses are spaced away from said first recesses to enable insertion of the female electric contact members, and, when the female electric contact members are inserted, for displacing said key towards the locking position in which the female electric contact members are gripped between said recesses.

14. The casing element according to claim 13, wherein said side walls comprise a length, and are connected at a point intermediate the length by a bridge forming an abutment for a retaining flap of a female electric contact member.

15. The casing element according to claim 13, wherein said plurality of grooves comprise three grooves of which one groove comprises a middle groove; and said means for holding said key in a ready position and for displacing said key towards a locking position comprise abutments in said middle groove comprising inclined ramp surfaces so that said inclined ramp can be passed, and the other two grooves comprise include hooks with non-inclined surfaces facing towards a bottom portion of said other two grooves; said lugs on said key being positioned on two opposite edges of said key adapted to cooperate with said non-inclined sides and said inclined ramp surfaces, said lugs, hooks and abutments being structured and arranged so that, when said lugs bear against said non-inclined sides of said hooks, said lugs of said key bear against said inclined ramp surfaces and said key is in the ready position, and, when said lugs of said key have passed said hooks and abutments, said key is in the locked position.

16. The casing element according to claim 13, wherein said complementary element comprises at least two angularly offset lateral bosses near a free end; and said plurality of channels of said casing element include an entry end, and include two screwthread parts at said entry end opening into longitudinal channels.

17. The casing element according to claim 13, wherein said casing element includes an end adjacent said plurality of channels, and said casing element is extended at said end adjacent said plurality of channels by a skirt, a gasket is positioned in said skirt, and said gasket includes openings aligned with said plurality of channels.

18. The casing element according to claim 13, wherein said casing element comprise two open parts on two opposite sides, and each of said two open parts is adapted to receive a key.

* * * * *